US010060684B2

(12) United States Patent
Maucher et al.

(10) Patent No.: US 10,060,684 B2
(45) Date of Patent: Aug. 28, 2018

(54) HEAT EXCHANGER

(71) Applicant: MAHLE International GmbH, Stuttgart (DE)

(72) Inventors: Ulrich Maucher, Korntal-Münchingen (DE); Jürgen Barwig, Vaihingen/Enz (DE); Steffen Ensminger, Notzingen (DE); Eberhard Pantow, Winnenden (DE); Claudia Lang, Abstatt (DE); Timo Peifer, Stuttgart (DE); Matthias Schmid, Stuttgart (DE); Jürgen Steimer, Esslingen (DE)

(73) Assignee: MAHLE INTERNATIONAL GMBH, Stuttgart (DE)

( * ) Notice: Subject to any disclaimer, the term of this patent is extended or adjusted under 35 U.S.C. 154(b) by 231 days.

(21) Appl. No.: 14/860,791

(22) Filed: Sep. 22, 2015

(65) Prior Publication Data

US 2016/0084582 A1 Mar. 24, 2016

(30) Foreign Application Priority Data

Sep. 22, 2014 (DE) ..... 10 2014 219 096

(51) Int. Cl.
*F28F 9/02* (2006.01)
*F28F 9/12* (2006.01)
(Continued)

(52) U.S. Cl.
CPC ..... *F28F 9/0219* (2013.01); *F28D 7/12* (2013.01); *F28D 7/163* (2013.01); *F28F 9/02* (2013.01); *F28F 9/0246* (2013.01); *F28F 9/12* (2013.01)

(58) Field of Classification Search
CPC .. F28F 9/18; F28F 9/182; F28F 9/0219; F28F 9/0224; F28F 2230/00; F28D 21/0003
See application file for complete search history.

(56) References Cited

U.S. PATENT DOCUMENTS 3,311,166 A * 3/1967 Southam ..... F28D 9/0081 165/166
6,269,870 B1 * 8/2001 Banzhaf ..... F01N 3/0205 165/158

(Continued)

FOREIGN PATENT DOCUMENTS

DE 102 29 083 A1 1/2004
DE 10 2007 010 134 A1 9/2008

(Continued)

OTHER PUBLICATIONS

European Search Report, Application No. 15184661.5, dated Feb. 11, 2016, 7 pgs.

(Continued)

*Primary Examiner* — Devon Russell
(74) *Attorney, Agent, or Firm* — Paul D. Strain, Esq.; Strain & Strain PLLC

(57) ABSTRACT

The invention relates to a heat exchanger having a tube bundle with tubes as heat exchanger matrix, it being possible for the tubes to be flowed through by a first fluid and in this way defining a first fluid channel, and to be flowed around by a second fluid and in this way defining a second fluid channel, the tube bundle being configured so as to be closed off toward the outside, in order to close off the second fluid channel, or being arranged in a housing, in order to close off the second fluid channel, the tubes being configured so as to be open on the end side for the inflow or outflow of the first fluid.

11 Claims, 7 Drawing Sheets

(51) Int. Cl.
*F28D 7/12* (2006.01)
*F28D 7/16* (2006.01)

(56) References Cited

U.S. PATENT DOCUMENTS 6,293,337 B1 * 9/2001 Strahle ..... F28D 9/0037 165/165
6,390,186 B1 * 5/2002 Laudic ..... F28D 7/16 165/158
7,159,650 B2 * 1/2007 Brost ..... F28D 9/0043 165/167
8,002,022 B2 * 8/2011 Geskes ..... F02B 29/0462 165/157
8,424,592 B2 * 4/2013 Meshenky ..... B21D 13/08 165/151
8,720,199 B2 * 5/2014 Gaensler ..... F28D 7/1653 165/157
2006/0185833 A1 * 8/2006 Brost ..... F28D 1/05366 165/149
2006/0207245 A1 * 9/2006 Yamaguchi ..... F01N 5/02 60/320
2006/0219394 A1 * 10/2006 Martin ..... F28D 9/0043 165/157
2008/0011464 A1 * 1/2008 Oofune ..... F28D 7/1684 165/157
2010/0044019 A1 * 2/2010 Maeda ..... F28D 7/0041 165/151
2010/0071871 A1 3/2010 Gaensler et al.
2010/0319889 A1 * 12/2010 Ikeda ..... F02B 29/0462 165/157
2011/0247318 A1 10/2011 Kuroyanagi et al.
2013/0146267 A1 6/2013 Garret et al.
2014/0014077 A1 * 1/2014 Schuricht ..... F28F 9/026 123/568.12

FOREIGN PATENT DOCUMENTS

DE 10 2011 014 704 A1 9/2012
EP 2 696 062 A1 2/2014
JP 2000-241086 A 9/2000
WO WO 2004/065874 A1 8/2004
WO WO 2011/ 073038 A1 6/2011

OTHER PUBLICATIONS

Extended European Search Report, Appl. No. 15184661.5, dated Jul. 7, 2016, 9 pgs.
German Search Report, Application No. DE 10 2014 219 096.7, dated Jul. 3, 2015, 8 pgs.

* cited by examiner

HEAT EXCHANGER

CROSS-REFERENCE TO RELATED PATENT APPLICATIONS

This application is based upon and claims the benefit of priority from prior German Patent Application No. 10 2014 219 096.7, filed Sep. 22, 2014, the entire contents of which are incorporated herein by reference in their entirety.

TECHNICAL FIELD

The invention relates to a heat exchanger, in particular a charge air cooler or an exhaust gas cooler for a motor vehicle, in particular according to the preamble of claim 1.

PRIOR ART

Exhaust gas coolers have the task of cooling hot exhaust gas from internal combustion engines, in order that said cooled exhaust gas can be mixed into the intake air again. Here, cooling to a very low level is to be aimed for in order to increase the thermodynamic degree of efficiency of an internal combustion engine. This principle is generally known as cooled exhaust gas recirculation and is used to achieve a reduction of pollutants, such as nitrogen oxides, in particular, in the exhaust gas.

The temperature transition from the very hot, uncooled gas inlet region on account of the hot gas at the gas inlet to that region of the cooler which is connected to the coolant leads to high stresses because of the different thermal expansion on account of the different temperatures which occur.

Furthermore, the routing of gas in the inlet region as a rule takes place by way of relatively thick-walled diffusers, in order for it to be possible to withstand the high pressures and temperatures, whereas the heat-exchanging parts of the heat exchanger are designed with walls which are as thin as possible for reasons of heat transfer and for cost and weight reasons. The joint between the gas inlet diffuser and the heat exchanger matrix is situated precisely in this region of the heat exchanger having the highest temperature gradients, where there is a change in thickness which additionally leads to pronounced stress concentrations. Said stress concentration leads to critical thermal stresses at defined regions of the heat exchanger. In particular, the corners of the heat exchanger matrix are frequently loaded greatly here.

The heat exchanger matrix is usually enclosed by a relatively thick-walled housing which conducts coolant and to which the gas inlet diffuser is connected, usually by way of welding or brazing. This has the advantage that such a pronounced jump in thickness does not occur and the stress concentrations are lower. If excessively high stresses nevertheless occur, a thicker-walled bottom or an additional reinforcement of the housing by way of a cast annular channel can be used.

The thermal deformations are prevented by way of relatively thick-walled, stiff components, such as by way of the coolant housing or the bottom of the susceptible, thin-walled heat exchanger tubes. This leads to a high component weight and to high costs.

SUMMARY OF THE INVENTION, PROBLEM, SOLUTION, ADVANTAGES

It is the problem of the invention to provide a heat exchanger which is improved in comparison with the prior art and exhibits a longer service life on account of reduced thermal stresses.

This is solved by way of the features of claim 1.

One exemplary embodiment of the invention relates to a heat exchanger having a tube bundle, the tubes of which are either arranged in a housing, can be flowed through by a first fluid and in this way define a first fluid channel, and can be flowed around by a second fluid and in this way define a second fluid channel, or the tube elements of which are stacked in an alternating manner and thus form tubes with a first fluid channel and a second fluid channel, the first fluid channel being configured so as to be open on the end side for the inflow or outflow of the first fluid, a diffuser being connected to the housing or to the tube bundle on at least one end side of the first fluid channel, the diffuser having a collar as plug-over region which is pushed over the housing or over the tube bundle, the diffuser having a wall thickness as material thickness, and the length of the plug-over region being greater than three times or four times the material thickness of the diffuser or the housing or the tube bundle.

It is advantageous here if the diffuser has a wall thickness as material thickness, and the length of the plug-over region is greater than from 5 times to 20 times the material thickness (d) of the diffuser or the housing or the tube bundle.

This is also solved by way of the features of claim 3.

One exemplary embodiment of the invention relates to a heat exchanger having a tube bundle, the tubes of which are either arranged in a housing, can be flowed through by a first fluid and in this way define a first fluid channel, and can be flowed around by a second fluid and in this way define a second fluid channel, or the tube elements of which are stacked in an alternating manner and thus form tubes with a first fluid channel and a second fluid channel, the first fluid channel being configured so as to be open on the end side for the inflow or outflow of the first fluid, a diffuser being connected to the housing or to the tube bundle on at least one end side of the first fluid channel, the diffuser having a collar as plug-over region which is pushed over the housing or over the tube bundle, the collar of the plug-over region having a cutout, in particular a slot, in the region of at least one corner.

This is also solved by way of the features of claim 4.

One exemplary embodiment of the invention relates to a heat exchanger having a tube bundle, the tubes of which are either arranged in a housing, can be flowed through by a first fluid and in this way define a first fluid channel, and can be flowed around by a second fluid and in this way define a second fluid channel, or the tube elements of which are stacked in an alternating manner and thus form tubes with a first fluid channel and a second fluid channel, the first fluid channel being configured so as to be open on the end side for the inflow or outflow of the first fluid, a diffuser being connected to the housing or to the tube bundle on at least one end side of the first fluid channel, the diffuser having a collar as plug-over region which is pushed over the housing or over the tube bundle, the collar of the plug-over region having a protuberance in the region of at least one corner.

It is advantageous if the plug-over length is greater in the region of a corner than between two corners.

This is also solved by way of the features of claim 6.

One exemplary embodiment of the invention relates to a heat exchanger having a tube bundle, the tubes of which are either arranged in a housing, can be flowed through by a first fluid and in this way define a first fluid channel, and can be flowed around by a second fluid and in this way define a second fluid channel, or the tube elements of which are stacked in an alternating manner and thus form tubes with a first fluid channel and a second fluid channel, the first fluid channel being configured so as to be open on the end side for the inflow or outflow of the first fluid, a diffuser being connected to the housing or to the tube bundle on at least one end side of the first fluid channel, the diffuser having a collar as plug-over region which is pushed over the housing or over the tube bundle, a connector stub with a flange being provided, furthermore, the flange being connected to the housing or to the tube bundle, the flange of the connector stub being connected to the plug-over region of the diffuser with a butt joint.

It is advantageous here if a collar which is likewise connected to the plug-over region and the collar is pushed onto the butt joint.

This is also achieved by way of the features of claim 8.

One exemplary embodiment of the invention relates to a heat exchanger having a tube bundle, the tubes of which are either arranged in a housing, can be flowed through by a first fluid and in this way define a first fluid channel, and can be flowed around by a second fluid and in this way define a second fluid channel, or the tube elements of which are stacked in an alternating manner and thus form tubes with a first fluid channel and a second fluid channel, the first fluid channel being configured so as to be open on the end side for the inflow or outflow of the first fluid, a diffuser being connected to the housing or to the tube bundle on at least one end side of the first fluid channel, the diffuser having a collar as plug-over region which is pushed over the housing or over the tube bundle, a connector stub with a collar being provided, furthermore, the collar of the connector stub being connected to the housing or to the tube bundle, the collar of the connector stub being connected so as to overlap with the plug-over region of the diffuser.

It is expedient here if the collar engages over the plug-over region or the plug-over region engages over the collar.

This is also solved by way of the features of claim 10.

One exemplary embodiment of the invention relates to a heat exchanger having a tube bundle, the tubes of which are either arranged in a housing, can be flowed through by a first fluid and in this way define a first fluid channel, and can be flowed around by a second fluid and in this way define a second fluid channel, or the tube elements of which are stacked in an alternating manner and thus form tubes with a first fluid channel and a second fluid channel, the first fluid channel being configured so as to be open on the end side for the inflow or outflow of the first fluid, a diffuser being connected to the housing or to the tube bundle on at least one end side of the first fluid channel, the diffuser having a collar as plug-over region which is pushed over the housing or over the tube bundle, a connector stub with a collar being provided, furthermore, the collar of the connector stub being connected to the housing or to the tube bundle, the collar with the connector stub and the plug-over region in each case having a protruding, expanded flange, which flanges are connected to one another.

Further advantageous refinements are described by the following description of the figures and by the subclaims.

BRIEF DESCRIPTION OF THE DRAWINGS

In the following text, the invention will be explained in greater detail on the basis of at least one exemplary embodiment using the drawings, in which.

PREFERRED EMBODIMENT OF THE INVENTION

Figure 1:
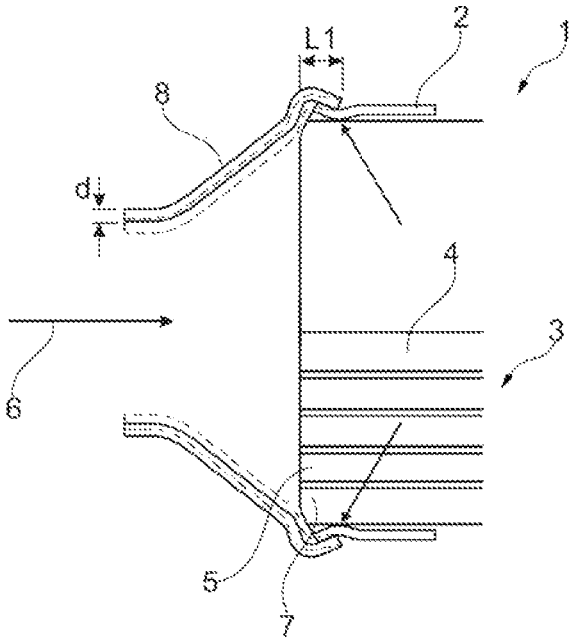
FIG. 1 shows a diagrammatic view of a diffuser according to the prior art, as placed onto an end region of a housing of a heat exchanger.

FIG. 1 shows a view of a housing 2 of a heat exchanger 1 according to the prior art, which has a tube bundle 3 with tubes 4, it being possible for the tubes 4 of the tube bundle 3 to be flowed through by a first fluid, and it being possible for the tubes 4 to be flowed around by a second fluid, with the result that a heat exchange can take place from the first fluid to the second fluid.

Here, the tubes 4 of the tube bundle 3 are configured so as to be open on their end sides 5, with the result that the first fluid can flow into the open tube ends 7 according to arrow 6. A diffuser 8 which is connected to the housing 2 is provided to distribute the first fluid to the tube ends 7. Here, the diffuser 8 engages over the housing 2 over the length L1. It has been shown here that, on account of the material thickness d of the diffuser and the lower material thickness in comparison of the housing 2 or the tubes 4, thermally induced stresses can be produced on account of the thermal expansion of the diffuser. This is indicated by the fact that the diffuser 8 is shown with a continuous line in the hot state and with an interrupted line in the cold state. The diffuser 8 widens under an increase in temperature and leads to stresses in the end region of the housing 2 and, in particular, where the diffuser 8 ends at the housing 2.

Figure 2:
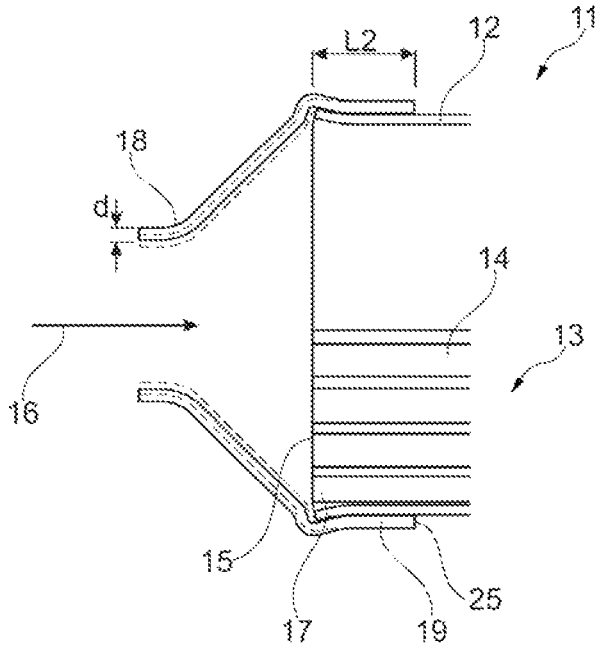
FIG. 2 shows a diagrammatic view of a diffuser, as placed onto an end region of a housing of a heat exchanger according to one concept of the invention.

FIG. 2 shows a view of a housing 12 of a heat exchanger 11 according to the invention, which housing 12 has a tube bundle 13 (also called a heat exchanger matrix) with tubes 14, it being possible for the tubes 14 of the tube bundle 13 to be flowed through by a first fluid, and it being possible for the tubes 14 to be flowed around by a second fluid, with the result that a heat exchange can take place from the first fluid to the second fluid. The tubes 14 of the tube bundle 13 are configured so as to be open on their end sides 15, with the result that the first fluid can flow into the open tube ends 17 according to arrow 16. A diffuser 18 which is connected to the housing 12 is provided to distribute the first fluid to the tube ends 17. Here, the diffuser 18 engages over the housing 12 over the length L2. It has been shown here that, on account of the material thickness d of the diffuser or the housing 2 or the tubes 14, and the greater length L2 according to the invention, a thermal expansion of the diffuser 18 does not cause any impermissibly pronounced thermally induced stresses.

The shaping of the diffuser can therefore achieve a situation where no critical thermally induced stresses are produced, in particular, in the connecting region to the heat exchanger matrix.

A certain plug-in or plug-over depth L2 is required to join the diffuser 18 and the housing 12, in order to ensure a stable welded or brazed seam. Said plug-over depth L2 is greater for brazed connections than for welded connections and, in the case of brazing, is preferably from 3 to 4 times the material thickness of the thinner join partner, that is to say of the housing 12 and the tubes 14. As a result, it is ensured as a rule that the brazed seam between the diffuser 18 and the housing 12 and the tubes 14 achieves the same strength as the thinner join partner, despite the lower strength of the brazed material.

According to the invention, the diffuser 18 is plugged with the length L2 over the tube bundle 13 and over the heat exchanger matrix, with the result that a reliable connection is produced and the thermally induced stresses are reduced. Here, the length L2 is considerably greater than would be necessary for the load-bearing capability of the brazed connection.

In the plugged-over region of the length L2, the diffuser 18 is connected to the housing 12 or to the tube bundle 13 in a full-area and non-positive manner, for example by way of brazing. To this end, the diffuser 18 has an approximately cylindrical or approximately rectangular region 19 which is oriented in the longitudinal direction of the housing 2 or the tube bundle 13 and engages around the housing 12 or the tube bundle 13 on the outside. Here, the diffuser 18 is preferably plugged over to such an extent that, in the plugged-over region 19, the temperature reaches approximately the temperature of the second fluid, that is to say the coolant temperature.

Figure 3:
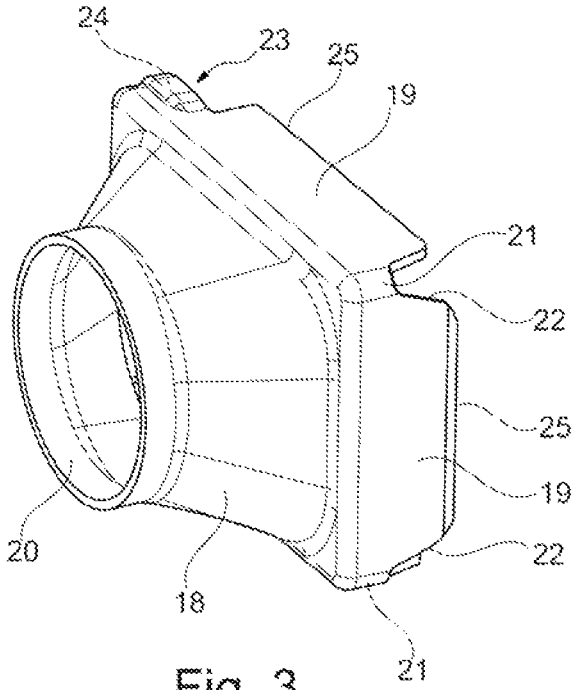
FIG. 3 shows a three-dimensional view of a diffuser.

FIG. 3 shows a diffuser 18 of this type in a three-dimensional illustration. The contour of the diffuser 18 widens in a flowing profile from the inlet 20 in the hot region toward the region 19, the region 19 being of cylindrical or rectangular or cuboid configuration, in order to enclose the housing 12 or the tube bundle 13 or the heat exchanger matrix in accordance with their design. Here, the stiffness of the diffuser 18 which has comparatively thick walls prevents pronounced constriction and therefore associated pronounced stress concentrations. The plug-over length L2 of the diffuser 18 is advantageously greater than 4 times the material thickness d of the diffuser 18, in order to achieve sufficient cooling of the diffuser 18 in the plug-over region 19. For the thermal conducting properties, in particular, of stainless steel components, a plug-over length L2 of more than 5 times the diffuser wall thickness d is advantageous; in particular, the plug-over length L2 is between 7 times and 20 times the diffuser wall thickness d.

The production of long cylindrical regions 19 is not possible to an unlimited extent. Accordingly, the result of simulations is that a large proportion of the effect is achieved by way of a diffuser with a long plug-over region even if the corners 21 of the plug-over region 19 are notched in a slotted or wedge-shaped manner. Accordingly, FIG. 3 shows slotted and wedge-shaped notches 22 in the corner regions of the plug-over region 19.

As an alternative to this or in addition, it can be provided that the corners 21 of the plug-over region 19 are widened toward the outside, as FIG. 3 shows. The corner region 23 is widened radially to the outside. The plug-over length in the widened corner region 23 is also reduced in comparison with the middle region of 19.

A greater radius and therefore improved formability of the corner region 23 are achieved by way of said widening in the corner region 23. A pocket 24 therefore results in the corner region 23 at the end of the plug-over region 19, which pocket 24 is not brazed to the housing 12 or the tube bundle 13 or the heat exchanger matrix, but which leads to circumferential support of the plug-over region 19 of the diffuser 18, which counteracts the constriction of the diffuser end 25. If cast parts are used as diffuser 18, said widened regions 24 with a greater radius can also remain non-machined, in order to lower the production costs.

The plug-over region 19 of the diffuser 18 can also be of slotted configuration in a sawtooth pattern or can be configured with cutouts for other components.

The plug-over region 18 also does not have to be of circumferential configuration, in order to completely engage around the housing 12 or the tube bundle 13 or the heat exchanger matrix; it can be sufficient if only the regions which are most critical for failure are engaged around, such as the corners of the heat exchanger matrix or regions with special shaping, for example for coolant conducting such as bowls or domes in disks or tubes or coolant inlets or outlets, etc.

Figure 4:
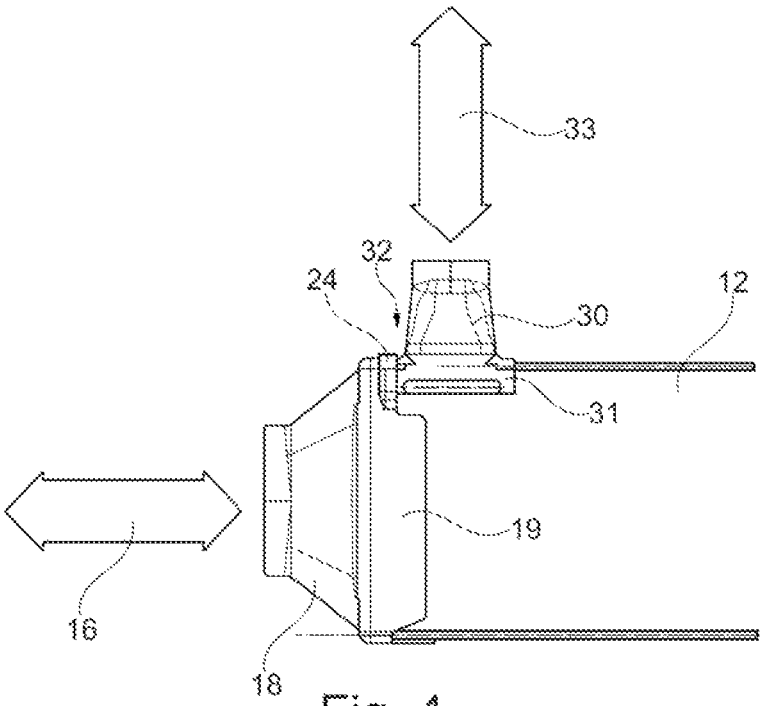
FIG. 4 shows a view of a diffuser and a connector stub which are arranged on a housing.

FIG. 4 shows a diffuser 18 according to FIG. 3 which engages with its plug-over region 19 over the housing and the tube bundle 13. Here, furthermore, a connector stub 30 with a circumferential collar 31 is provided, the circumferential collar 31 bearing against the housing 12 or against the tube bundle 13. Here, the collar 31 is pushed partially on one side 32 under the widened region 24, in order for it to be possible to bear sealingly against the housing 12 or against the tube bundle 13. The connector stub 30 serves to feed in or discharge the second fluid according to arrow 33, the diffuser 18 serving to feed in or discharge the first fluid according to arrow 16.

Figure 5:
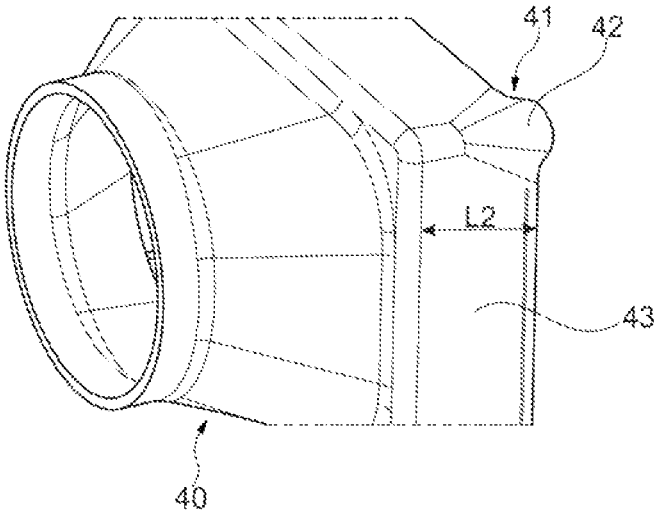
FIG. 5 shows a three-dimensional view of a diffuser.
Figure 6:
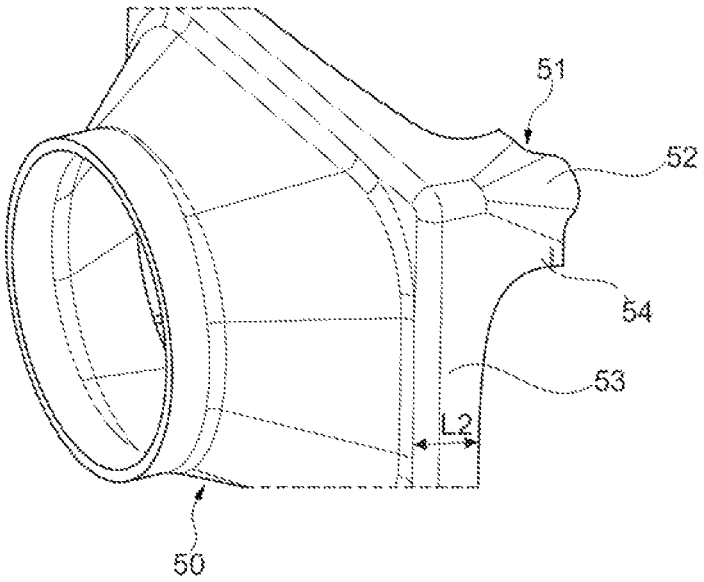
FIG. 6 shows a three-dimensional view of a diffuser.

FIGS. 5 and 6 show diffusers 40 and 50 which are configured in accordance with the diffuser 18 of FIG. 3, widened portions 42, 52 being provided at the corner regions 41, 51 instead of the slot 22. Here, in the exemplary embodiment of FIG. 5, the plug-over length L2 is substantially constant over the circumference of the plug-over region 43. In the exemplary embodiment of FIG. 6, the plug-over length L2 is not constant over the circumference of the plug-over region 53. Rather, the plug-over length L2 is smaller between the corner regions 51 than at the corner regions 51 themselves.

As an alternative to this, a two-piece embodiment might also be provided instead of the extended plug-over region 19 of the diffuser 18, in which two-piece embodiment a sleeve can be pushed over the housing or the heat exchanger matrix; the wall thickness of the sleeve should be at least 30%, advantageously more than 50% of the diffuser wall thickness d, and the same lengths should be provided for the plug-over length as for the single-piece diffuser 18.

As a result, in heat exchangers with a housing or else without a housing, a diffuser is connected either to the housing or directly to the heat exchanger matrix, it being possible for the thermally induced stresses to be kept low. As a result, the thermal strength can be increased considerably. In designs without a housing, the diffuser wall thickness is usually a multiple of the disk or tube wall thickness of the heat exchanger matrix. A large plug-over region according to the invention of the diffuser 18 has resulted in an increase in the service life of the heat exchanger.

FIGS. 7 to 12 show different variants of how a heat exchanger with a housing or else without a housing but with a tube bundle can be configured with a diffuser and a connector stub with a circumferential collar, with the result that the collar can be fastened sealingly to the housing or to the tube bundle. Here, the diffuser is preferably brazed to a connector stub which forms a fluid box. As a result, a stiff assembly with a high wall thickness and therefore satisfactory thermal conduction is produced, as a result of which the temperature jumps are reduced greatly. A flowing geometry profile is accordingly set, and the stresses in the components can be reduced in such a way that the thermal strength can be increased.

According to the invention, the diffuser has a joining face with the connector stub which forms a fluid box in the region of the collar, which joining face is connected non-positively by way of brazing or welding.

Figure 7:
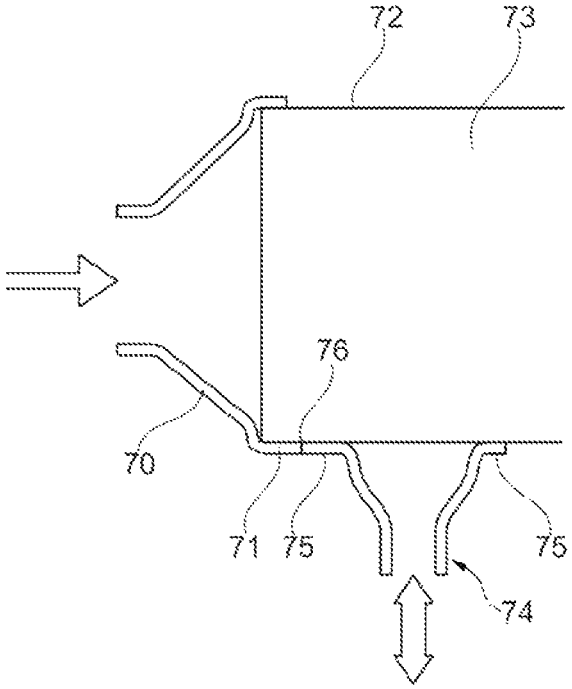
FIG. 7 shows a diagrammatic sectional view of the housing with diffuser and connector stub.

In the simplest case, the two components diffuser and collar of the connector stub can be set obtusely onto one another, with the result that a joining face of the width of the material thickness of the thinner component, such as of the diffuser or the connector stub, is produced. This is shown by FIG. 7. The diffuser 70 engages with its plug-over region 71 around the housing 72 or the tube bundle or the heat exchanger matrix 73, depending on whether a housing 72 is provided. Here, the connector stub 74 is arranged and fastened with its collar 75 on the housing 72 or on the tube bundle 73. Here, the collar 75 abuts the plug-over region 71 of the diffuser 70 obtusely. The connection takes place via the brazed seam 76. In this way, a considerable improvement in the thermal strength can already be achieved.

Since joined seams, in particular brazed seams with nickel-based brazing materials, in stainless steel coolers often have a considerably lesser strength than the basic materials, however, the brazed seam 76 as joined seam 76 still represents an improvable connection in the case of obtuse joining. In addition, obtuse brazing does not make any tolerance compensation possible for dimensional fluctuations of the individual parts or positional deviations during the assembly of the cooler.

An enlarged joined seam can be achieved, for example, by virtue of the fact that one of the join partners is plugged over the other; here, the joined seam preferably lies approximately parallel to the pressing-on direction of the diffuser. The width of the joining gap can thus be enlarged, in particular to a width of more than one material thickness of the thinner join partner. In addition, tolerance compensation is thus also made possible.

Figure 8:
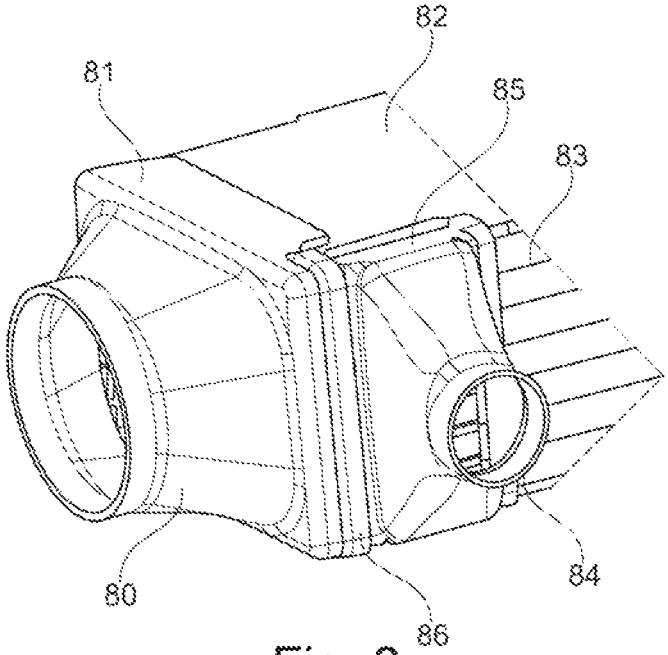
FIG. 8 shows a diagrammatic sectional view of the housing with diffuser and connector stub.
Figure 9:
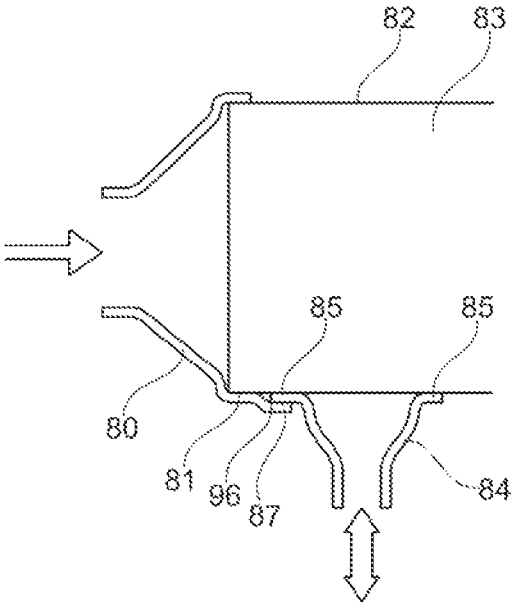
FIG. 9 shows a three-dimensional view of the housing with diffuser and connector stub.

FIGS. 8 and 9 show one exemplary embodiment, in which the collar of the connector stub is pushed under the diffuser. The diffuser 80 engages with its plug-over region around the housing 82 or the tube bundle or the heat exchanger matrix 83, depending on whether a housing 82 is provided. Here, the connector stub 84 is arranged and fastened with its collar 85 on the housing 82 or on the tube bundle 83.

Here, the collar 85 is pushed under a bulge 86 of the plug-over region 81 of the diffuser 80. The connection takes place via the brazed seam 87 which is enlarged and is arranged substantially parallel to the plug-on direction of the diffuser 80. In this way, a considerable improvement in the thermal strength can already be achieved.

Figure 10:
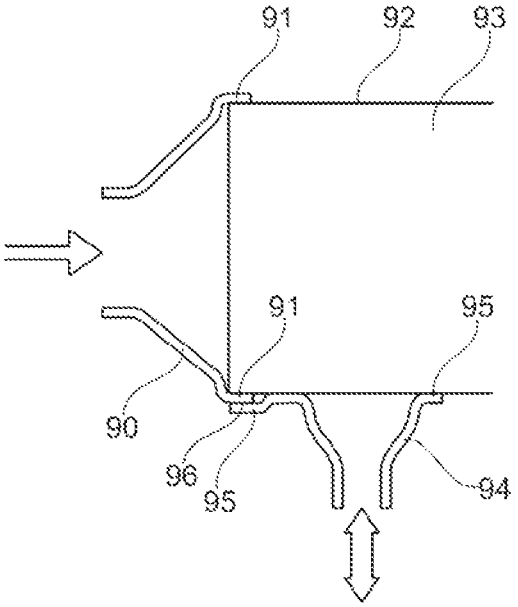
FIG. 10 shows a diagrammatic sectional view of the housing with diffuser and connector stub.

FIG. 10 shows one exemplary embodiment, in which the collar of the connector stub is pushed over the diffuser. The diffuser 90 engages with its plug-over region around the housing 92 or the tube bundle or the heat exchanger matrix 93, depending on whether a housing 92 is provided. Here, the connector stub 94 is arranged and fastened with its collar 95 on the housing 92 or on the tube bundle 93.

Here, the collar 95 engages over the plug-over region 91 of the diffuser 90. The connection takes place via the brazed seam 96 which is enlarged and arranged substantially parallel to the plug-on direction of the diffuser 90. In this way, a considerable improvement in the thermal strength can likewise be achieved.

Figure 11:
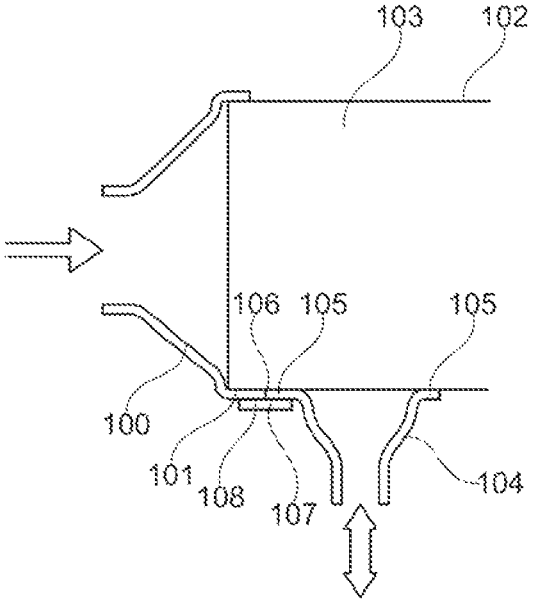
FIG. 11 shows a diagrammatic sectional view of the housing with diffuser and connector stub.

FIG. 11 shows a further exemplary embodiment, in which the collar of the connector stub is arranged in abutment with the plug-over region of the diffuser, a collar being pushed over the butt joint. The diffuser 100 engages with its plug-over region 101 around the housing 102 or the tube bundle or the heat exchanger matrix 103, depending on whether a housing 102 is provided. Here, the connector stub 104 is arranged and fastened with its collar 105 on the housing 102 or on the tube bundle 103. Here, the collar 105 is arranged in abutment next to the plug-over region 101 of the diffuser 100. Furthermore, a collar 107 is pushed over the butt joint 106, which collar 107 improves the connection because the brazed seam is enlarged. The connection takes place via the brazed seam 108 which, in addition to the brazed seam in the butt joint 106, is arranged substantially parallel to the plug-on direction of the diffuser 100. In this way, a considerable improvement in the thermal strength can likewise be achieved.

Figure 12:
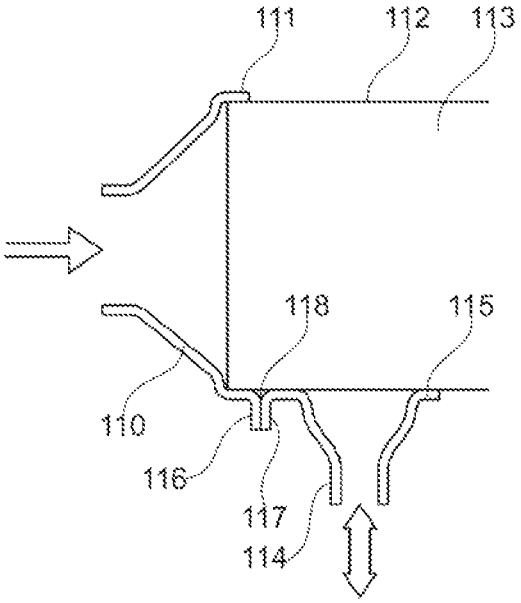
FIG. 12 shows a diagrammatic sectional view of the housing with diffuser and connector stub.
Figure 13:
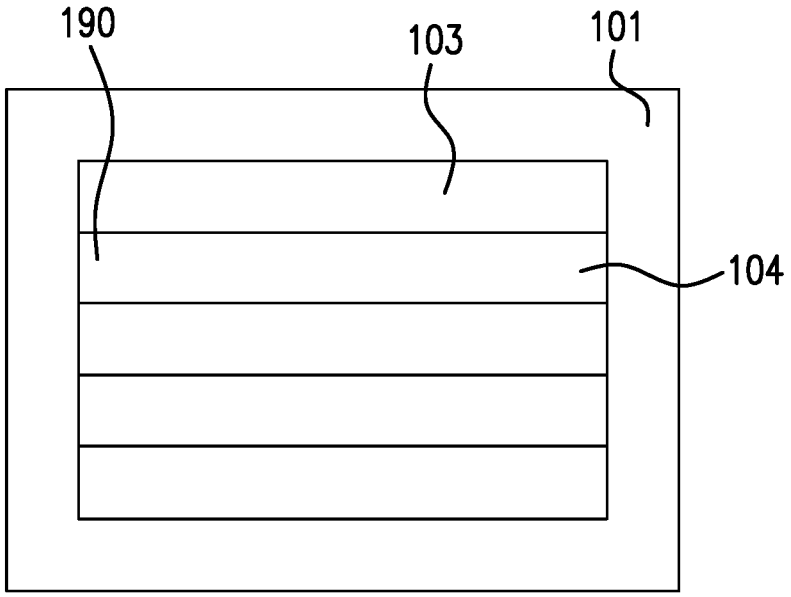
FIG. 13 is a block diagram depicting an exemplary embodiment of the application, in which heat exchanger (101) optionally includes a tube bundle (103) formed as a plurality of stacked disks (104), in which the ends (190) are closed off by longitudinal beads or a step-like widened portion or constriction. The block diagram of FIG. 13 shows connection only and is not intended to show structural features such as relative size, orientation, and spacing.

FIG. 12 shows a further exemplary embodiment, in which the collar of the connector stub and the plug-over region 111 of the diffuser 110 are expanded and in each case form a radially oriented flange, which flanges bear against one another. The diffuser 110 engages with its plug-over region 111 around the housing 112 or the tube bundle or the heat exchanger matrix 113, depending on whether a housing 112 is provided. Here, the connector stub 114 is arranged and fastened with its collar 115 on the housing 112 or on the tube bundle 113.

The collar 115 and the plug-over region form expanded flanges 116, 117 which project in the radial direction or perpendicularly with respect to the longitudinal direction of the housing 112 or the heat exchanger matrix 113. The two flanges 116, 117 are brazed to one another, which enlarges the brazed seam 118. In this way, a considerable improvement in the thermal strength can likewise be achieved.

The invention claimed is:

1. A heat exchanger having a tube bundle, wherein the tube bundle comprises:

(a) tubes arranged in a housing which each define a first flow channel for a first fluid, wherein the tubes can be flowed around by a second fluid and in this way define second flow channels for the second fluid, or (b) tube elements stacked in an alternating manner to form tubes alternately defining first flow channels for a first fluid and second flow channels for a second fluid; and wherein the first flow channels are configured to be open on an end side to permit inflow or outflow of the first fluid, wherein a diffuser is connected to the housing or to the tube bundle on the end side of the first flow channels, wherein the diffuser comprises a collar having a wall thickness and formed as a plug-over region configured to be pushed over a region of the housing at the end side or over a region of the tube bundle at the end side, wherein a length of the plug-over region is at least three times the wall thickness of the plug-over region of the diffuser, a thickness of a housing wall contacting the plug-over region, or a thickness of a tube bundle wall contacting the plug-over region, and wherein the plug-over region comprises a slotted or wedge-shaped notch arranged in at least one corner region of the plug-over region.

2. The heat exchanger according to claim 1, wherein the length of the plug-over region is from 5 times up to 20 times the thickness of the plug-over region of the diffuser, a thickness of a housing wall contacting the plug over region, or a thickness of a tube bundle wall contacting the plug over region.

3. The heat exchanger according to claim 1 further comprising a connector stub having a collar, wherein the collar is connected to the housing or to the tube bundle so as to overlap with the plug-over region of the diffuser such that the collar engages over the plug-over region or the plug-over region engages over the collar.

4. The heat exchanger according to claim 3, wherein the plug-over region engages over the collar.

5. The heat exchanger according to claim 1, wherein the tube bundle is formed from a plurality of stacked plates or plate pairs which form the first and second flow channels in an alternating manner between themselves.

6. The heat exchanger according to claim 5, wherein the first flow channels are configured as open on the end side and the second flow channels are configured as closed on the end side.

7. The heat exchanger according to claim 1, wherein the tube bundle is configured in accordance with option (a).

8. The heat exchanger according to claim 7, wherein the tubes comprise longitudinal beads at their edges which seal the second flow channel against the outside.

9. The heat exchanger according to claim 7, wherein the tubes comprise an end region having a step-like widened portion or constriction such that the first or second flow channels are closed in the end region.

10. The heat exchanger according to claim 9, wherein the housing does not seal the second flow channel against the outside.

11. A heat exchanger having a tube bundle, wherein the tube bundle comprises:

(a) tubes arranged in a housing which each define a first flow channel for a first fluid, wherein the tubes can be flowed around by a second fluid and in this way define second flow channels for the second fluid, or (b) tube elements stacked in an alternating manner to form tubes alternately defining first flow channels for a first fluid and second flow channels for the second fluid; and wherein the first flow channels are configured to be open on an end side to permit inflow or outflow of the first fluid, wherein a diffuser is connected to the housing or to the tube bundle on the end side of the first flow channels, wherein the diffuser comprises a collar having a wall thickness and formed as a plug-over region configured to be pushed over a region of the housing at the end side or over a region of the tube bundle at the end side, wherein a length of the plug-over region is at least three times the wall thickness of the plug-over region of the diffuser, a thickness of a housing wall contacting the plug-over region, or a thickness of a tube bundle wall contacting the plug-over region, wherein the plug-over region comprises a slotted or wedge-shaped notch arranged in at least one corner region of the plug-over region, and further comprising a connector stub having a collar, wherein the collar is connected to the housing or to the tube bundle so as to overlap with the plug-over region of the diffuser such that the plug-over region engages over the collar.

* * * * *